US008272323B2

(12) United States Patent
Mullikin

(10) Patent No.: US 8,272,323 B2
(45) Date of Patent: Sep. 25, 2012

(54) ADJUSTABLE CHARACTER STAMP

(75) Inventor: Jeffrey A. Mullikin, Andrews, SC (US)

(73) Assignee: Peddinghaus Corporation, Bradley, IL (US)

( * ) Notice: Subject to any disclaimer, the term of this patent is extended or adjusted under 35 U.S.C. 154(b) by 589 days.

(21) Appl. No.: 12/609,551

(22) Filed: Oct. 30, 2009

(65) Prior Publication Data

US 2011/0100237 A1 May 5, 2011

(51) Int. Cl.
*B44B 5/00* (2006.01)

(52) U.S. Cl. ..... 101/3.1; 101/18

(58) Field of Classification Search ..... 101/3.1
See application file for complete search history.

(56) References Cited

U.S. PATENT DOCUMENTS

| | | | | |
|---|---|---|---|---|
| 2,035,149 | A | 3/1936 | Dolan | |
| 2,164,616 | A * | 7/1939 | Manny | 408/30 |
| 2,661,681 | A | 12/1953 | Fenstermaker | |
| 3,198,052 | A * | 8/1965 | Persson | 83/516 |
| 3,554,060 | A * | 1/1971 | Gargrave et al. | 76/107.1 |
| 5,502,994 | A * | 4/1996 | Katoh et al. | 72/327 |
| 5,896,773 | A * | 4/1999 | Lee | 72/428 |
| 6,519,831 | B2 * | 2/2003 | Futamura et al. | 29/564.7 |
| 7,418,773 | B2 | 9/2008 | Simek | |
| 2002/0157236 | A1 * | 10/2002 | Futamura et al. | 29/564.7 |
| 2005/0022680 | A1 * | 2/2005 | Plattet et al. | 101/3.1 |
| 2005/0257361 | A1 * | 11/2005 | Ramnauth et al. | 29/430 |
| 2009/0188364 | A1 * | 7/2009 | Lahtinen | 83/549 |

FOREIGN PATENT DOCUMENTS

| | | |
|---|---|---|
| FR | 2 641 640 | 7/1990 |

* cited by examiner

*Primary Examiner* — Anthony Nguyen

(74) *Attorney, Agent, or Firm* — Wood, Phillips, Katz, Clark & Mortimer

(57) ABSTRACT

An adjustable stamp for stamping characters on a workpiece, including a base plate with a platen, a plurality of stamps each having a raised character on one side, a stamp holder, and a support securing the stamps to the holder in an array while allowing limited free motion of the stamps relative to each other in the stamping and retract directions. The support is mounted to the base plate for movement in a plane substantially perpendicular to the stamping direction to selectively position one of the stamps over the platen. The base plate and the workpiece may be pressed together, whereby the raised character of the one stamp is stamped into the workpiece by the platen pressing against the opposite side of the one stamp, with the free motion of the other stamps preventing their raised characters from being stamped into the workpiece.

23 Claims, 17 Drawing Sheets

ADJUSTABLE CHARACTER STAMP

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention relates to a stamp for stamping characters on a workpiece, particularly on the legs of a structural angle.

BACKGROUND OF THE INVENTION AND TECHNICAL PROBLEMS POSED BY THE PRIOR ART

Stamping of workpieces with a variety of identifying information is required in many applications. For example, workpieces may advantageously include part identifying information stamped thereon to help to ensure that the correct part pieces are used in the correct applications and/or in the correct locations.

Workpieces which are not simply flat and/or are made of strong material can be particularly difficult to stamp with desired identifying information. For example, structural angle workpieces (e.g., angle irons) may have two longitudinal members connected at right angles along an edge (often by bending a single flat longitudinal member along a line extending in the longitudinal direction), and typically are made of strong metals such as steel or iron to provide the strength required in many construction and manufacturing applications.

Machines have, of course, been used which can be used to stamp identifying information on workpieces, usually in a facility where the workpieces are being worked on (e.g., where a long blank is being punched to provide whatever holes are required for the intended use of the part pieces, with individual elements being sheared from the blank to form the individual part pieces). Moreover, due to the difficulty of such stamping, machines separate and apart from the punching and shearing machines have often been provided to accomplish the stamping.

For example, in one prior art stamping machine, a wheel of hardened raised letter stamps is rotated to orient to the proper character next to the workpiece. That character is then pressed against the workpiece one character at a time until all of the characters of the identifying information have been stamped thereon. Another prior art stamping machine places several stamps into one holder, and then stamps the entire identifying information (e.g., part number) at one time.

Both of the above methods and machines fix the stamps rigidly in a frame and require them to be driven up (into the material of the workpiece) to create or stamp the required characters. Driving up of the materials is done with a separate hydraulic cylinder or cylinders. Some designs use a floating head that requires only one cylinder; some use a rigid design that requires one cylinder to raise the stamps from their lowered position up to touch the material and another cylinder to squeeze the material producing the character(s). In either case, the cost of such machines includes not only the stamps themselves, but also the cost of the drive structure to move the stamps up to the workpiece.

The present invention is directed toward overcoming one or more of the problems set forth above.

SUMMARY OF THE INVENTION

The present invention provides a novel, improved stamp for imprinting or stamping characters in a workpiece, and is particularly advantageously suited to stamp selected characters in workpieces. This is accomplished with a compact structure which may be easily operated and controlled with minimal addition of parts, particularly when used in conjunction with a punch module.

In one aspect of the present invention, an adjustable stamp for stamping characters on a workpiece is provided, including a base plate with a platen, a plurality of stamps each having a raised character on one side, a stamp holder, and a support securing the stamps to the holder in an array. The supported stamps have one side facing a stamping direction and the opposite side facing a retract direction opposite the stamping direction. The support allows limited free motion of the stamps relative to each other in the stamping and retract directions, and is mounted to the base plate for movement in a plane substantially perpendicular to the stamping direction to selectively position a selected one of the stamps over the platen with the platen facing the opposite side of the selected one of the stamps. The base plate and the workpiece may be pressed together, whereby the raised character of the selected one of the stamps is stamped into the workpiece by the platen pressing against the opposite side of the one stamp, and the free motion of the other stamps prevents their raised characters from being stamped into the workpiece.

In one form of this aspect of the invention, the stamp holder is a character holding plate having an opening therethrough, and the support includes a plurality of dowel pins surrounding the character holding plate opening, and a plurality of elastic O-rings looped over the dowel pins on opposite sides of the character holding plate opening to support the stamps in the opening of the character holding plate. In further forms, (a) the character holding plate opening is substantially rectangular and the array is a generally rectangular matrix with a plurality of columns and rows in the opening, and (b) one set of the O-rings extends in one ring direction between the dowels across the character holding plate opening and the remaining ones of the O-rings extend between the dowels in a second ring direction perpendicular to the first ring direction. In yet another further form, (c) the stamps include grooves between the one sides and the opposite sides, and at least some of the O-rings are received in the grooves to support the stamps, with the elasticity of the O-rings allows the limited free motion, and in a still further form the O-rings provide selected spacing between the supported stamps in the array.

In another form of this aspect of the invention, a null stamp is supported in the array with the plurality of stamps, the null stamp being flat on its one side.

In still another form of this aspect of the invention, the stamping direction is substantially perpendicular to the surface of the workpiece when stamping.

In yet another form of this aspect of the invention, the support is mounted to the base plate by first and second tracks extending in first and second axial directions substantially perpendicular to each other, the first and second axial directions also being substantially perpendicular to the stamping and retracting directions. In a further form, the second track is carried by the first track, the support is carried by the second track, a first drive selectively positions the second track along the first axial direction relative to the base plate, and a second drive selectively positions the support along the second axial direction relative to the first track, whereby the supported stamps are positioned relative to the platen so that the stamp having the raised character to be stamped is selectively positioned over the platen. In still further forms, (a) the first and second tracks are slide bearings, and (b) the first and second drives are multi-position air cylinders. In yet another further form, (c) the stamp holder is a character holding plate having an opening therethrough, and the support is a plurality of dowel pins surrounding the character holding plate opening, and a plurality of elastic O-rings looped over the dowel pins on opposite sides of the character holding plate opening to support the stamps in the opening of the character holding plate, and in a still further form the stamps include grooves between the one sides and the opposite sides, and at least some of the O-rings are received in the grooves to support the stamps, and the elasticity of the O-rings allows the limited free motion.

In still another form of this aspect of the invention, a base plate drive is adapted to rotate the base plate around the workpiece to orient the stamping direction substantially perpendicular to the surface of the workpiece to be stamped.

In another aspect of the present invention, a punch and stamp for working on a workpiece includes a base plate and a top plate secured together for controlled motion toward and away from each other, a workpiece drive adapted to move the workpiece longitudinally between the base plate and top plate, and a biasing drive adapted to move the base and top plates toward and away from each other. A punching member is secured to the top plate and adapted to be selectively extended from the top plate to punch a hole in the workpiece when the base and top plates are moved toward each other. An adjustable stamp is secured to the base plate, and includes a platen, a plurality of stamps each having a raised character on one side, a stamp holder, and a support securing the stamps to the holder in an array with the one side of the stamps facing a stamping direction and the opposite side of the stamps facing a retract direction opposite the stamping direction. The support allows limited free motion of the stamps relative to each other in the stamping and retract directions, and is supported for movement on the base plate in a plane substantially perpendicular to the stamping direction to selectively position a selected one of the stamps over the platen with the platen facing the opposite side of the selected one of the stamps. When the base biasing drive moves the base and top plates together so that the selected one of the stamps engages the workpiece, the raised character of the selected one of the stamps is stamped into the workpiece by the platen pressing against the opposite side of the one stamp, and the free motion of the other stamps prevents their raised characters from being stamped into the workpiece.

In one form of this aspect of the invention, the stamp holder is a character holding plate having an opening therethrough, and the support includes a plurality of dowel pins surrounding the character holding plate opening, and a plurality of elastic O-rings looped over the dowel pins on opposite sides of the character holding plate opening to support the stamps in the opening of the character holding plate. In further forms, (a) the character holding plate opening is substantially rectangular and the array is a generally rectangular matrix with a plurality of columns and rows in the opening, (b) one set of the O-rings extends in one ring direction between the dowels across the character holding plate opening and the remaining ones of the O-rings extend between the dowels in a second ring direction perpendicular to the first ring direction, and (c) the stamps include grooves between the one sides and the opposite sides, and at least some of the O-rings are received in the grooves to support the stamps, with the elasticity of the O-rings allows the limited free motion.

In another form of this aspect of the invention, the support is mounted to the base plate by first and second tracks extending in first and second axial directions substantially perpendicular to each other, the first and second axial directions also being substantially perpendicular to the stamping and retracting directions. In a further form, the second track is carried by the first track, the support is carried by the second track, a first drive selectively positions the second track along the first axial direction relative to the base plate, and a second drive selectively positions the support along the second axial direction relative to the first track, whereby the supported stamps are positioned relative to the platen so that the stamp having the raised character to be stamped is selectively positioned over the platen.

In still another form of this aspect of the invention, a base plate drive is adapted to rotate the base plate around the workpiece to orient the stamping direction substantially perpendicular to the surface of the workpiece to be stamped.

BRIEF DESCRIPTION OF THE DRAWINGS

FIG. 5A omits the stamps and supporting O-rings,

FIG. 5B omits the stamps, supporting O-rings and the top plate of the stamp holder, and FIG. 5C omits the stamps, supporting O-rings and the stamp holder;

DETAILED DESCRIPTION OF THE INVENTION

Figure 1:
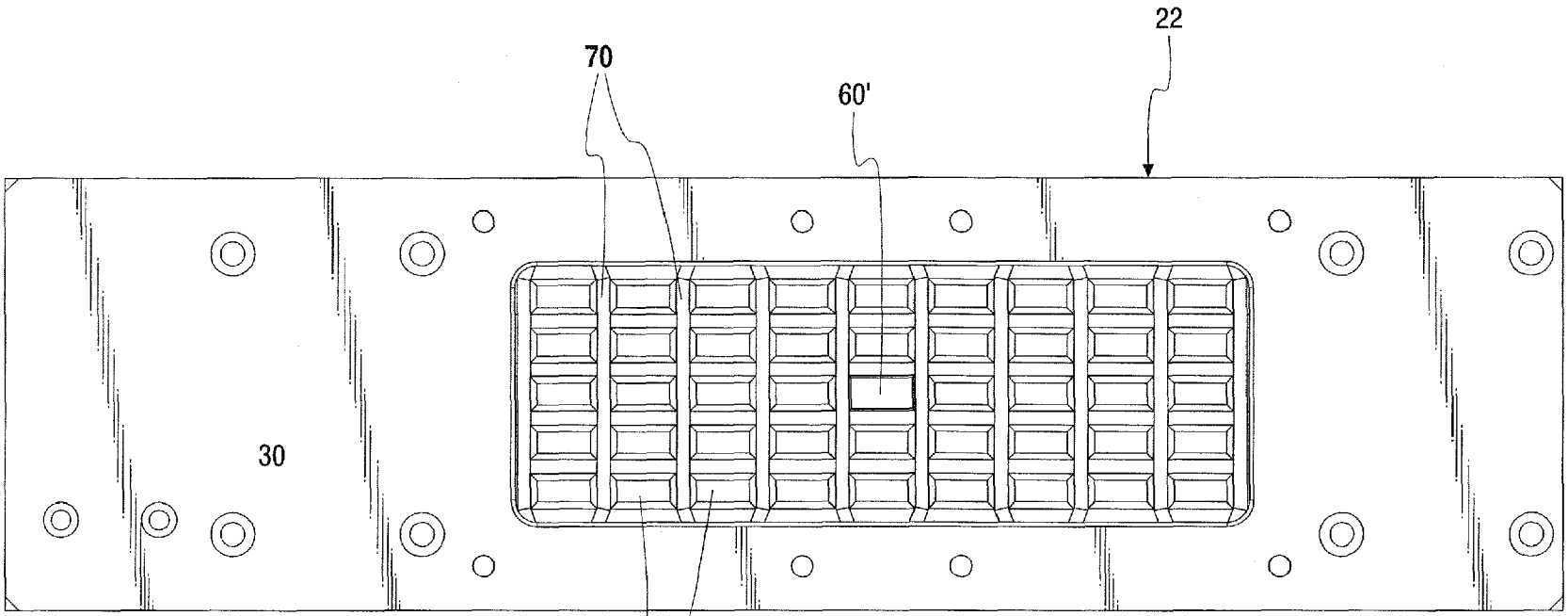
FIG. 1 is a top view of a stamp holder and supported stamps embodying one embodiment of the present invention.
Figure 2A:
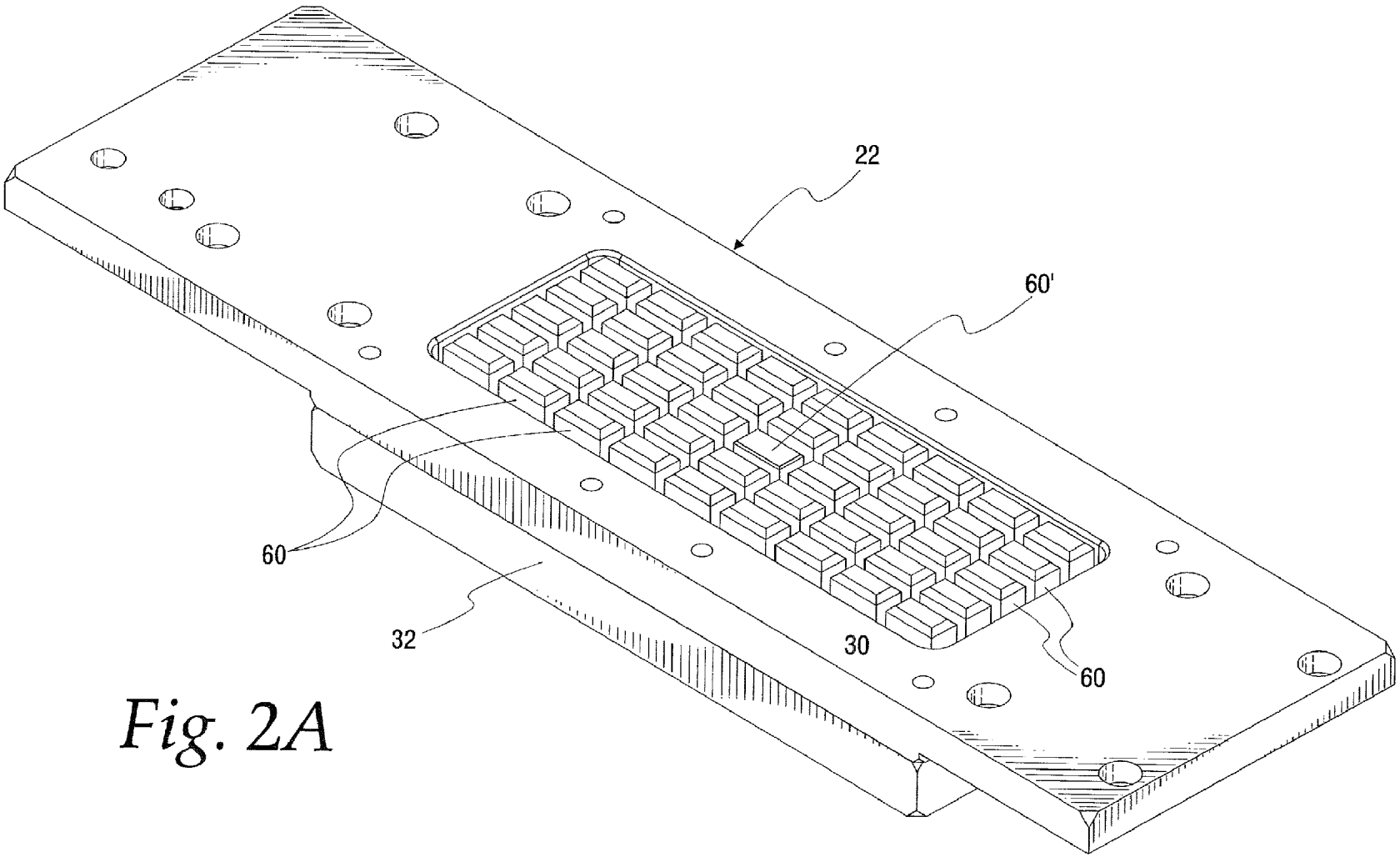
FIG. 2A is an isometric view of the FIG. 1 stamp holder and stamps.
Figure 2B:
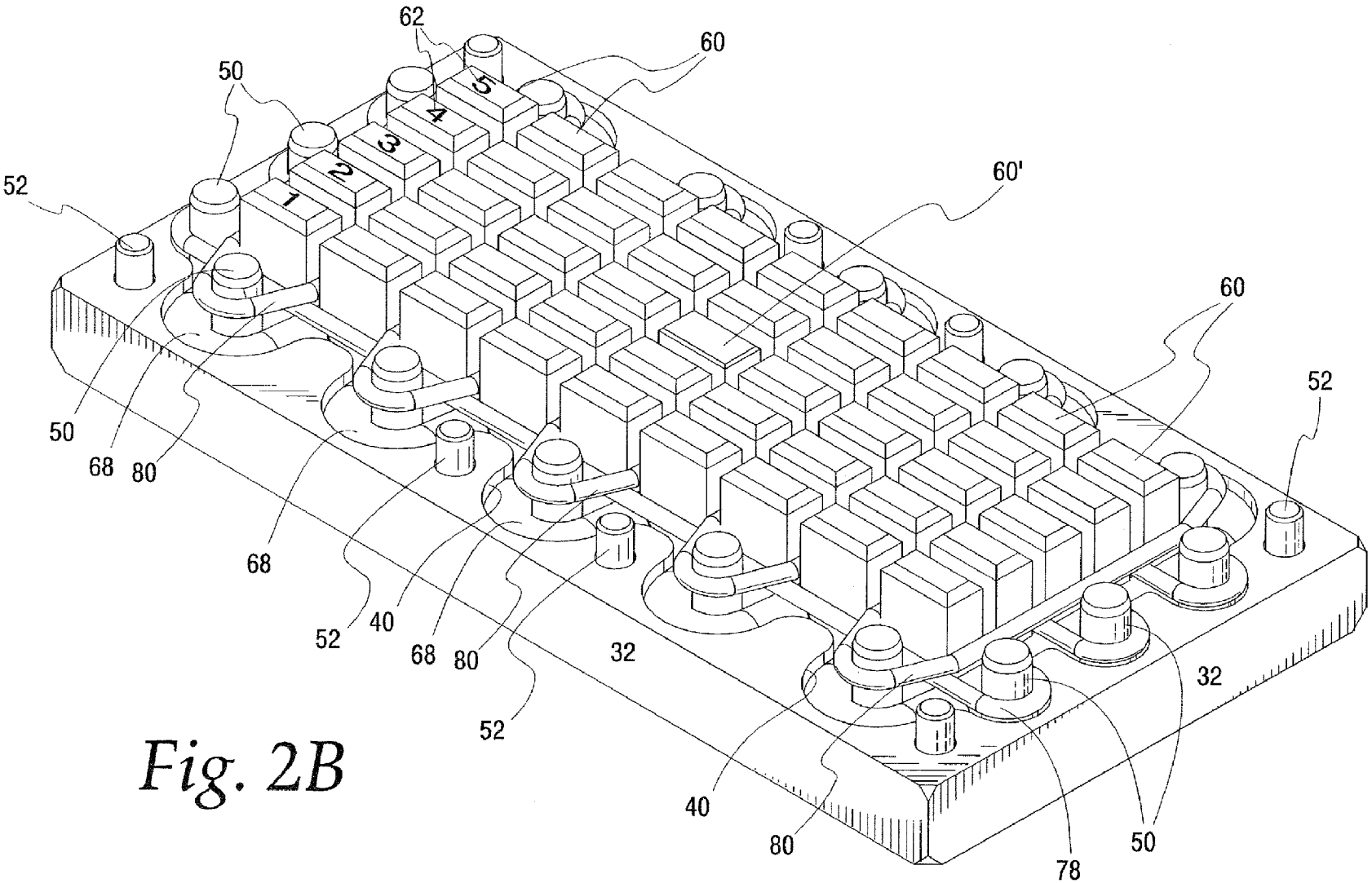
FIG. 2B is an isometric view similar to FIG. 2A, with the top plate removed.
Figure 2C:
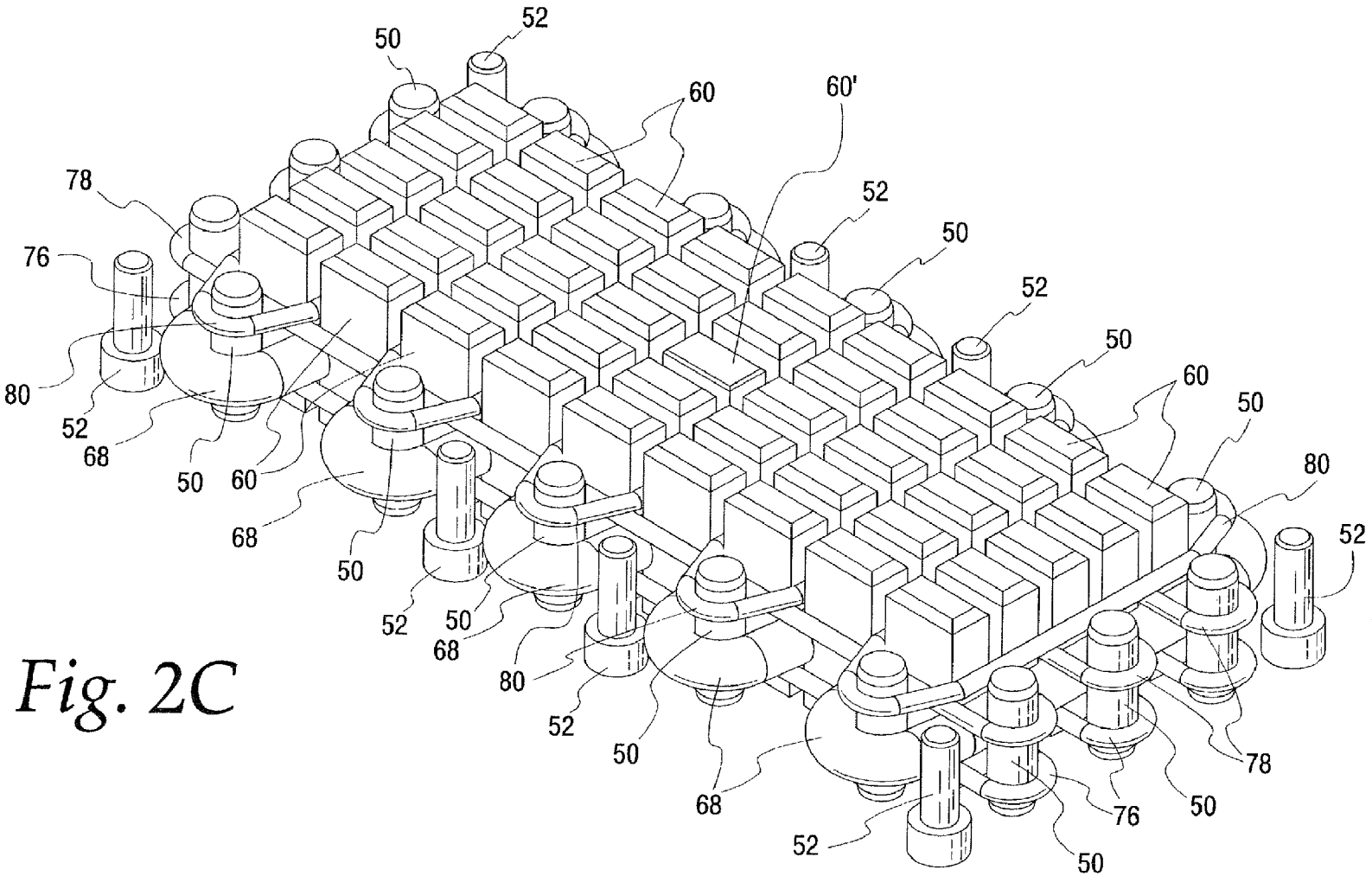
FIG. 2C is an isometric view similar to FIG. 2A, with both the top and bottom plates removed.

While this invention is susceptible of embodiment in many different forms, this specification and the accompanying drawings disclose only one specific form as an example of the use of the invention. The invention is not intended to be limited to the embodiment so described, and the scope of the invention will be pointed out in the appended claims.

For ease of description, the apparatus operating in accordance with this invention is described in the normal (upright) operating position, and terms such as upper, lower, horizontal, etc., are used with reference to this position.

The apparatus of this invention can have certain conventional components and control mechanisms the details of which, although not fully illustrated or described, will be apparent to those having skill in the art and an understanding of the necessary functions of such components and mechanisms.

Some of the Figures illustrating the preferred embodiment of the apparatus of the present invention show conventional structural details and mechanical elements or components that will be recognized by one skilled in the art. However, the detailed descriptions of such elements are not necessary to an understanding of the invention, and accordingly, are herein presented only to the degree necessary to facilitate an understanding of the novel features of the present invention.

In accordance with the illustrated embodiment of an adjustable stamp 20 of the present invention, a stamp holder 22 and structure for supporting a plurality of stamps 24 in the stamp holder 22 are illustrated in FIGS. 1-4.

Specifically, the stamp holder 22 includes a top plate 30 and a bottom plate 32 (see FIGS. 2A and 4), both of which have a substantially rectangular opening 34, 36 therethrough. The bottom plate 32 also has a plurality of recesses 40 around its rectangular opening 36 including mounting recesses 42 therein. The top plate 30 has similar aligned recesses 44 and mounting recesses (not shown). A plurality of dowel pins 50 may be trapped in the mounting recesses 42, 44 between the top and bottom plates 30, 32 (for a purpose as described in greater detail hereafter) when the plates 30, 32 are suitably secured together (e.g., by screws or bolts 52 extending through aligned holes in the plates 30, 32), with the pins 50 being substantially parallel and spaced around the plate openings 34, 36.

A plurality of stamps 60 are arranged in a array, for example, with forty-five stamps 60 such as the five by nine matrix shown in the Figures. One side of most of the stamps 60 includes a hardened raised character 62 (see, e.g., the "1", "2", "3", "4" and "5" raised characters 62 illustrated in one row of stamps 60 in FIG. 2B). The raised characters 62 may be any design which may be desired for stamping in a workpiece with which the adjustable stamp 20 is used, including alphanumeric characters (e.g., 0-9, A-Z) and other symbols or designs. One of the stamps 60 may be shorter than the rest, and/or without a raised character 62, such as shown in the middle of the illustrated five by nine matrix, to serve as a null character when stamping is not desired (as is explained further below). It should be appreciated the stamps 60 may each have different raised characters 62 (or none as with the null character), and only five such characters 62 are illustrated in only FIG. 2B to prevent clutter in the drawings.

Advantageously, the stamps 60 are supported in the matrix configuration in the aligned openings 34, 36 of the plates 30, 32. Specifically, grooves 66 may be advantageously provided on opposite sides of the bodies of the stamps 60 (see particularly FIGS. 3-4). Suitably sized O-rings 68 looped over the dowel pins 50 on opposite sides of the plate openings 34, 36 are received in the aligned grooves 66 of adjacent stamps 60. For example, as illustrated, five O-rings 68 provide ten legs 70 extending across the openings 34, 36, whereby eight of the legs are received in adjacent grooves 66 between the nine rows and the outer two legs are received in the outwardly facing grooves 66 of the stamps 60 in the end rows of the matrix.

Figure 4:
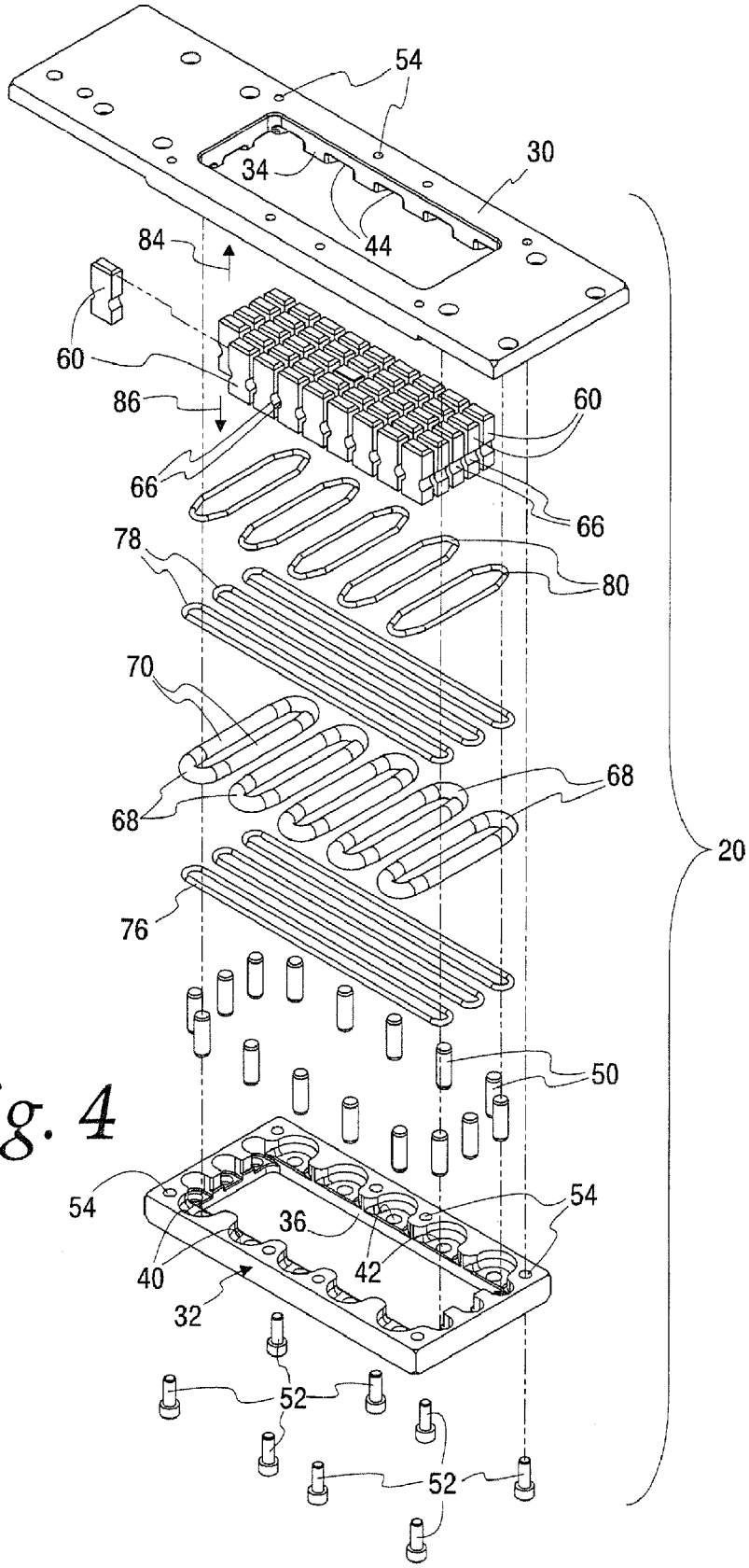
FIG. 4 is an exploded view of the stamp holder and supported stamps of FIGS. 1-3.
Figure 5A:
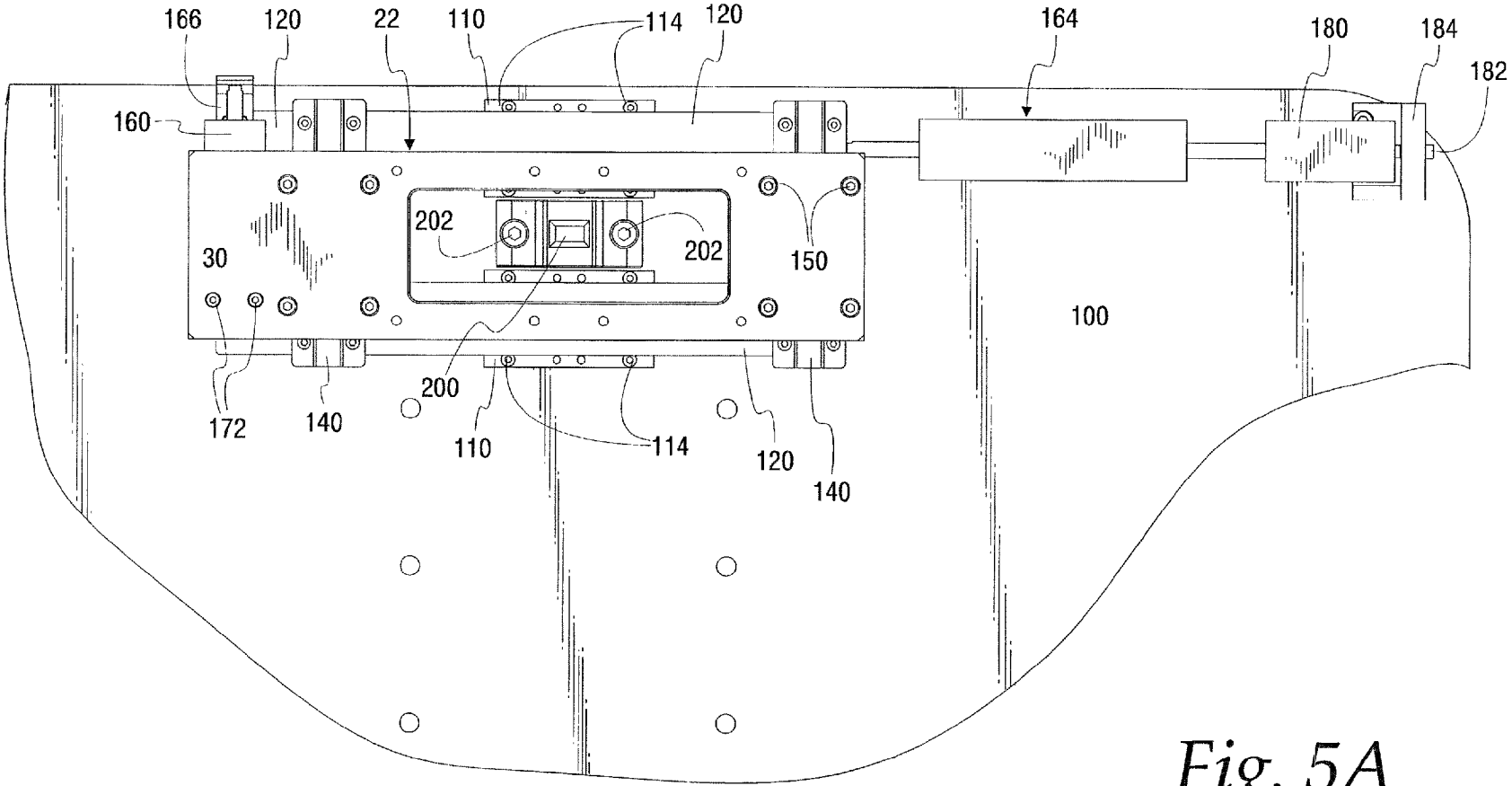
FIGS. 5A-5C are top views showing the stamp holder of FIGS. 1-4 as movably secured to a base plate, with various components omitted to illustrate further details, where.
Figure 5B:
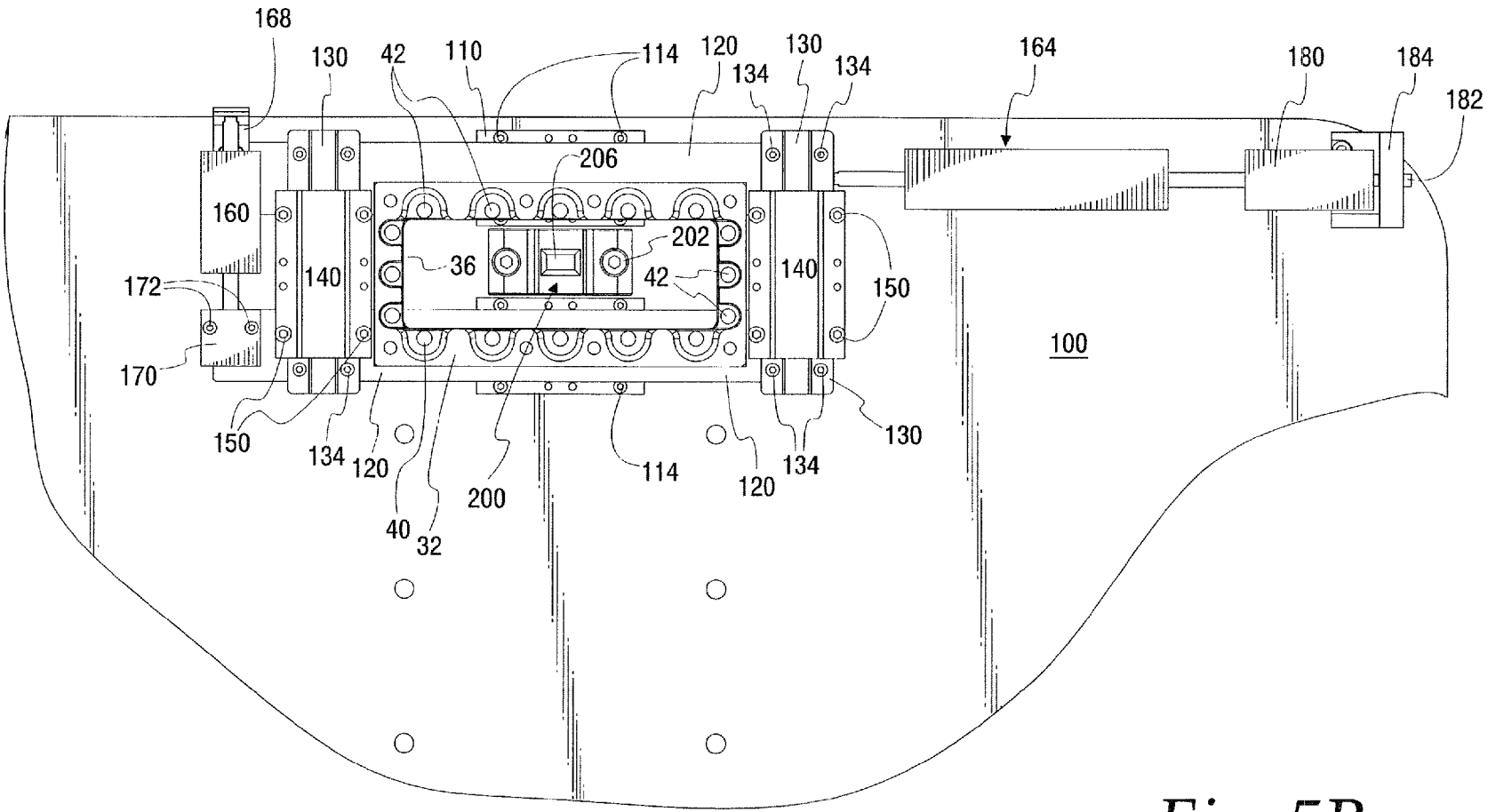
Figure 5C:
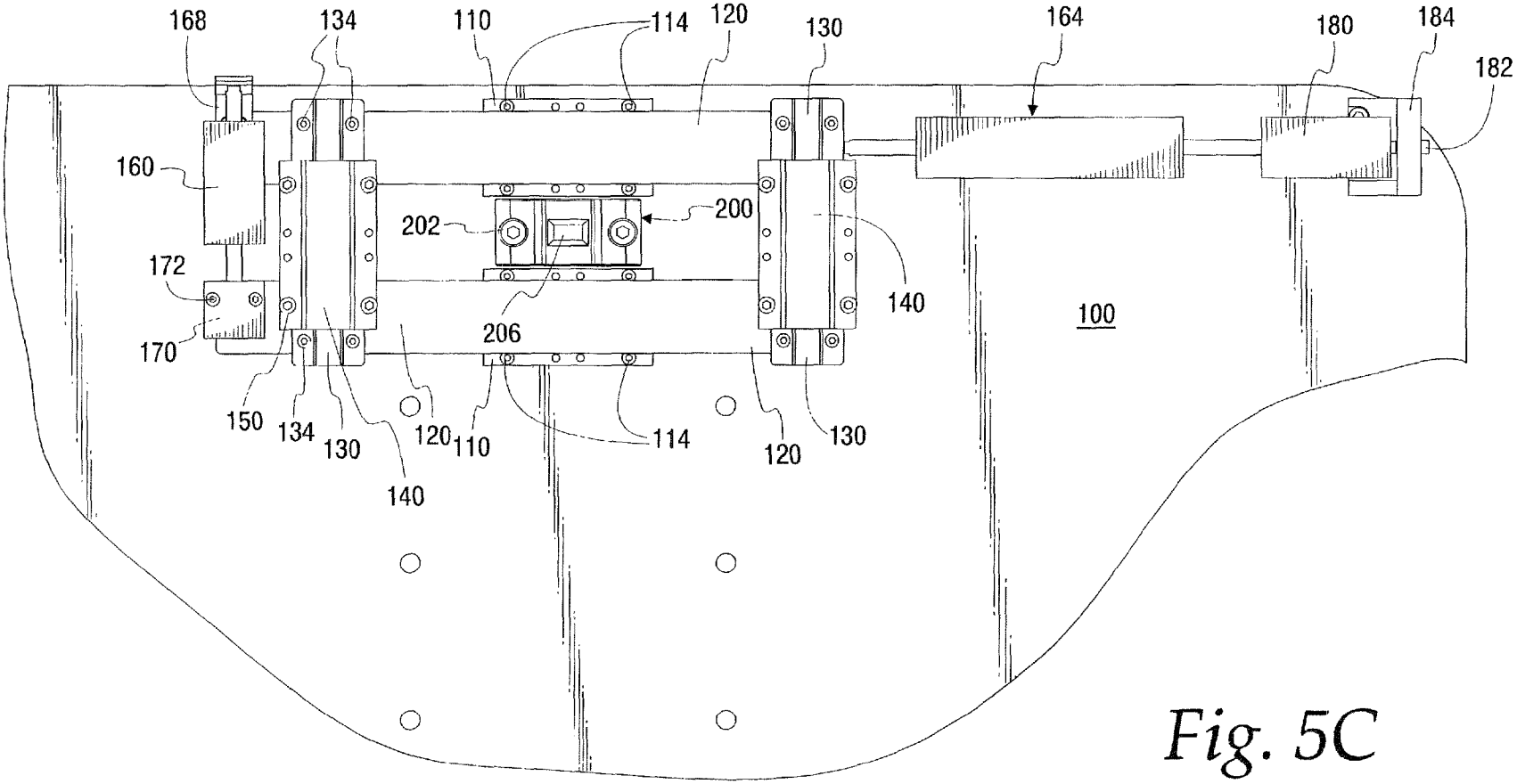
Figure 6A:
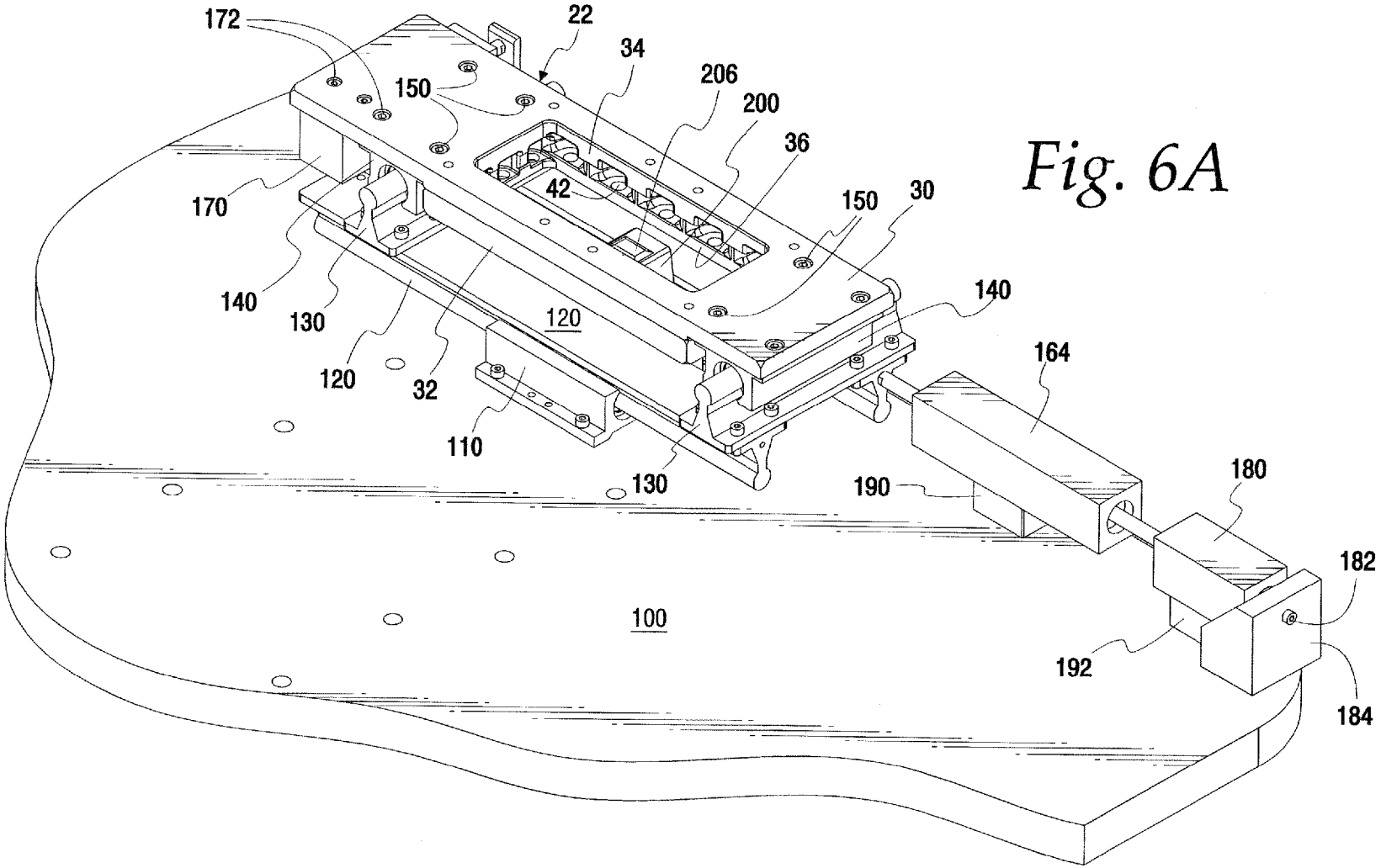
FIGS. 6A-6C are perspective views corresponding to FIGS. 5A-5C, wherein the components omitted in FIG. 5A are omitted in FIG. 6A, those omitted in FIG. 5B are omitted in FIG. 6B, and those omitted in FIG. 5C are omitted in FIG. 6C.
Figure 6B:
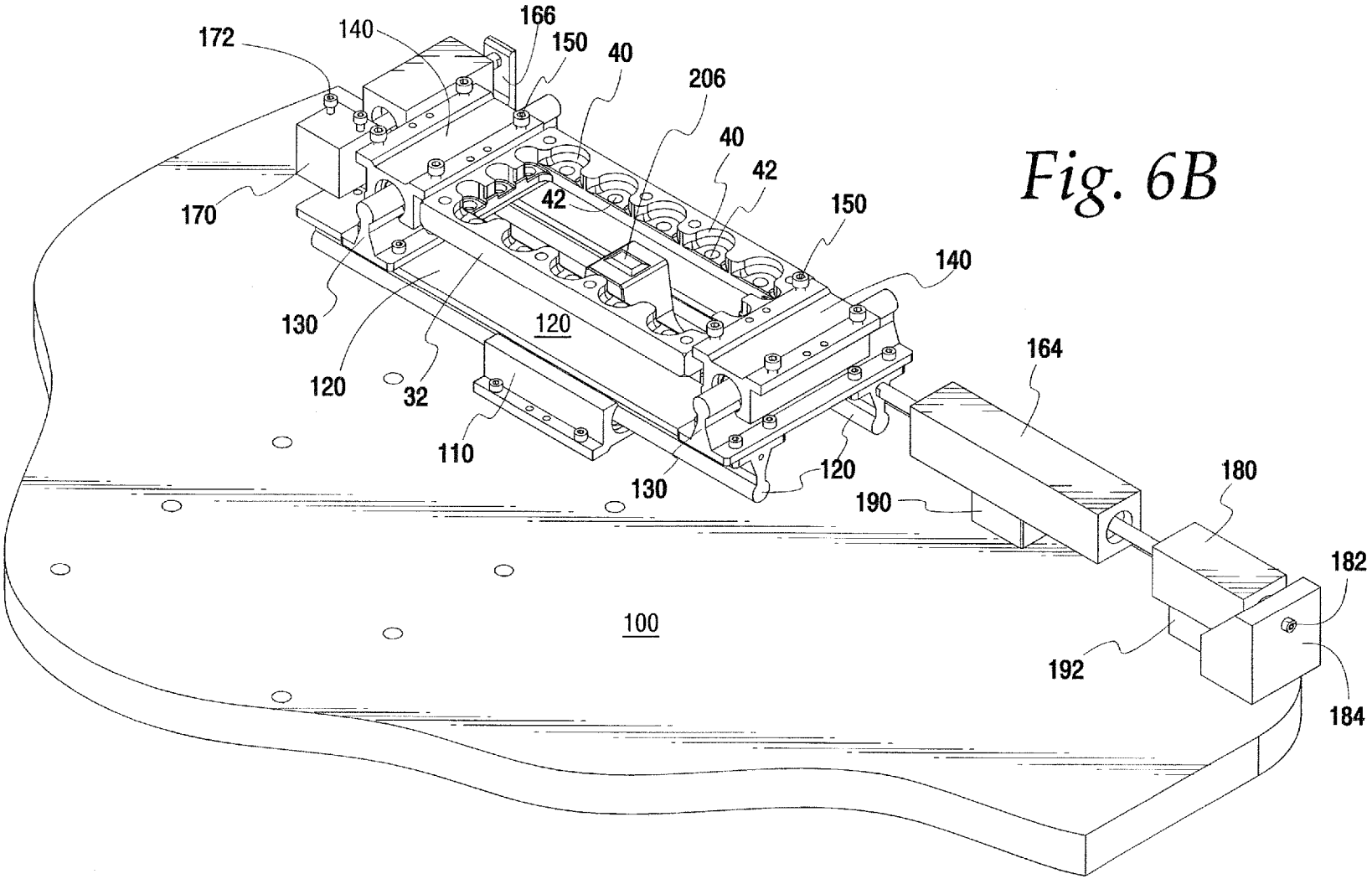
Figure 6C:
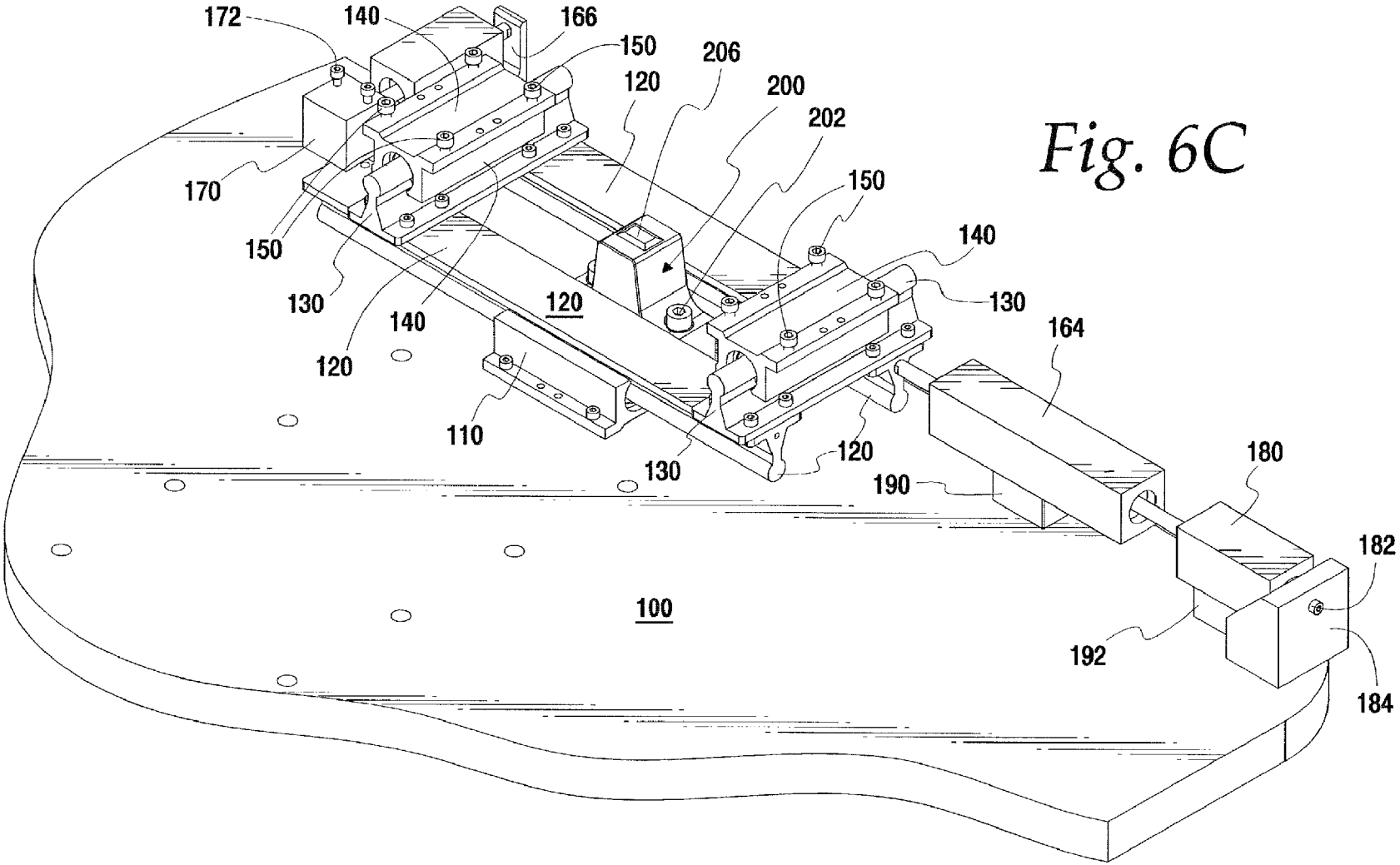
Figure 7:
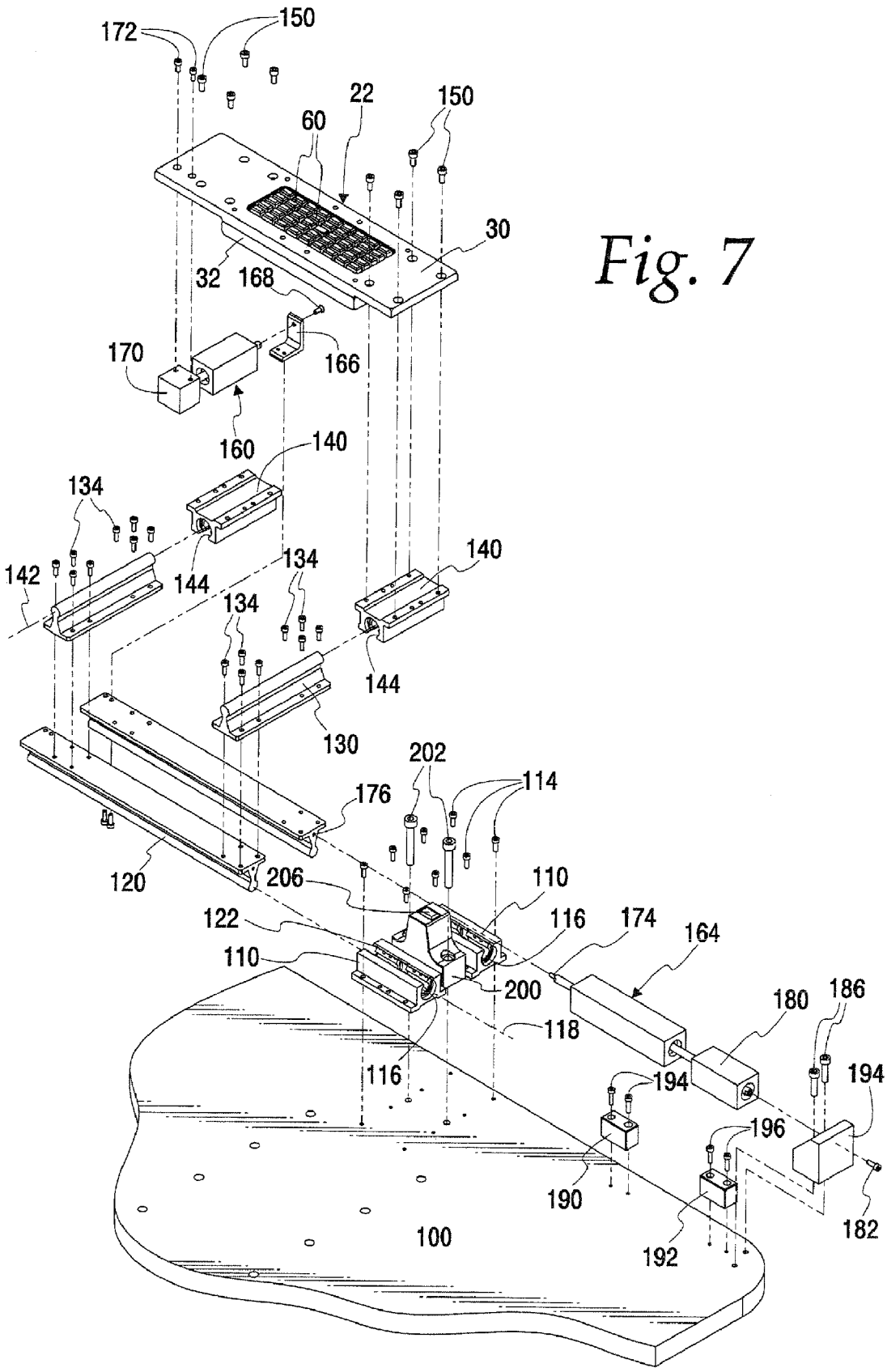
FIG. 7 is an exploded perspective view of the structure movably supporting the stamp holder (with supported stamps) on a movable base plate.
Figure 8C:
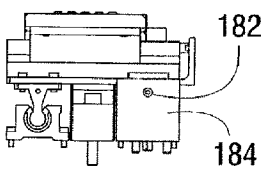
FIGS. 8A-8E are front, left, right, top and bottom views of the movably supporting structure and stamp holder (with supporting stamps) of FIG. 7, with the base plate omitted.
Figure 8D:
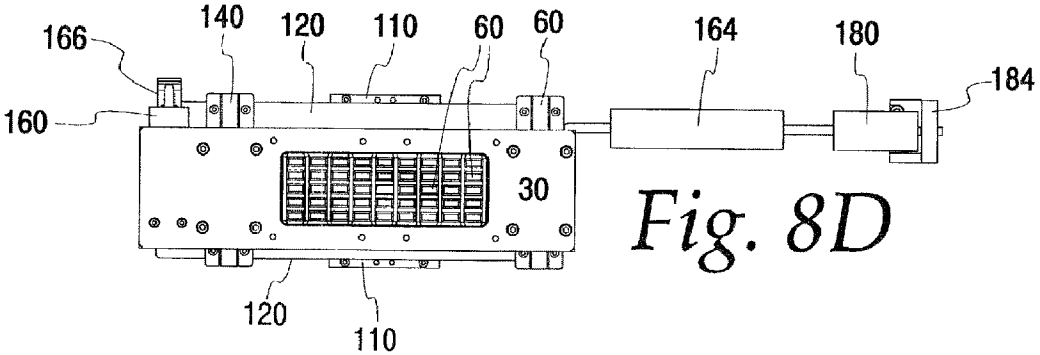
Figure 8A:
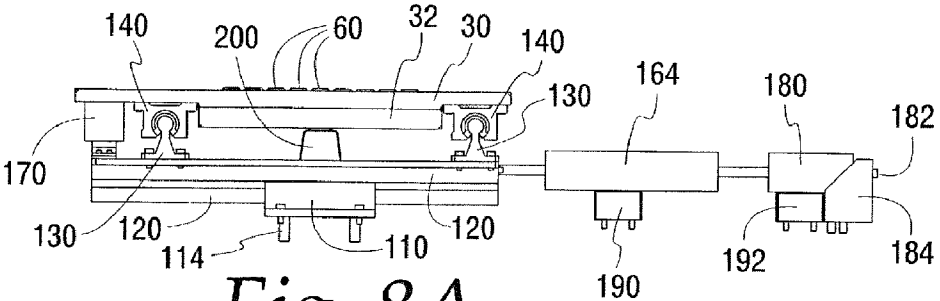
Figure 8E:
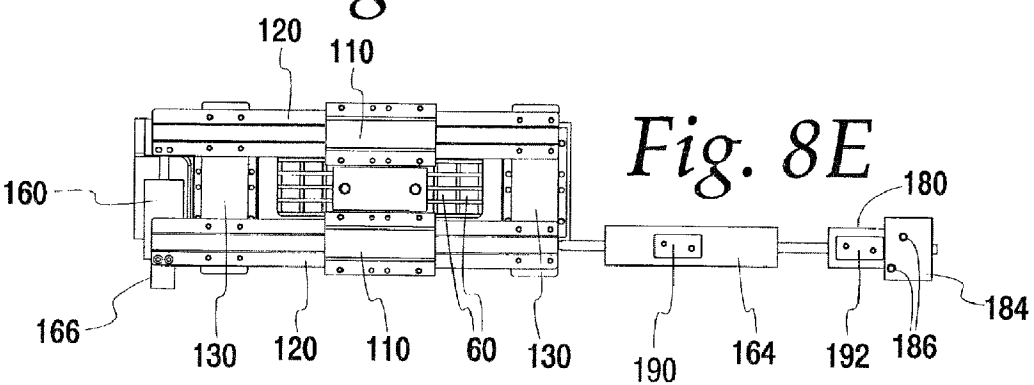
Figure 8B:
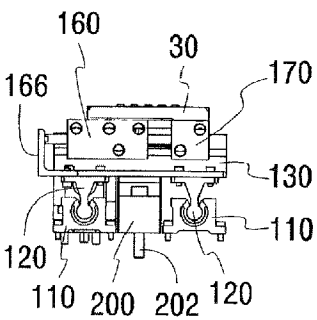

Additional sets of O-rings may also be looped over the dowel pins 50 on opposite sides of the openings 32, 34 to facilitate the maintenance of reliable spacing between the stamps 60 in the matrix, as well as to help to ensure that each of the stamps 60 remains oriented properly. For example, as illustrated in FIG. 4, two sets of O-rings 76, 78 may be looped over dowel pins 50 on opposite sides of the transverse direction of the openings 34, 36, and a third set of O-rings 80 may be looped over the same dowel pins 50 as the supporting O-rings 68. With a five by nine matrix as illustrated, O-ring sets 76, 78 would include three O-rings each, whereas O-ring sets 68, 80 would include five O-rings each. Advantageously the different sets of O-rings may be arranged in alternating crisscross directions.

It should be appreciated that the rectangular matrix layout if the stamps 60 substantially minimizes the overall size of the adjustable stamp 20, as well as minimizing the distance required to move from one character to the next. It should be appreciated, however, that advantages of the present invention could be obtained with opening shapes which are not rectangular such as illustrated, and with O-rings which may extend in more than two directions. It should also be appreciated that more than one set of O-rings 68 and grooves 66 could be used to support a rectangular or different matrix of stamps 60.

It should thus be appreciated that while the O-rings 68, 76, 78, 80 will support and maintain the stamps 60 in the desired array (e.g., the five by nine matrix) while at the same time allowing limited free motion of the stamps 60 relative to each other in the stamping and retracting directions 84, 86 (see FIG. 4) due to the elasticity of the O-rings, particularly the supporting O-rings 68.

FIGS. 5A-8E illustrate the mounting of the stamp holder 22 described above in connection with FIGS. 1-4 to a base plate 100. For clarity of illustration, the stamps 60 and O-ring sets 68, 76, 78, 80 are omitted from the openings 34, 36 of the top and bottom plates 30, 32. It should be appreciated that the base plate 100 may be advantageously oriented substantially parallel to a surface of a workpiece which is desired to be stamped, with the base plate 100 and workpiece suitably pressed toward each other for stamping as described in further detail hereafter.

Specifically, a pair of tracks 110 are suitably secured (e.g., by screws or bolts 114; see FIG. 7) to the base plate 100 in a parallel orientation. The tracks 110 each include a generally cylindrical guide track 116 extending in a first axial direction 118 which is generally parallel to the surface of the base plate 100. A slit in the top of the guide tracks 116 permits a pair of rails 120 to be received and retained in, and move relative to, the tracks 110 in the first axial direction 118. The guide tracks 116 may include suitable structures to facilitate easy and smooth movement of the rails 120 in the tracks 116, such as slide bearings 122.

The rails 120 are rigidly held together by a second set of rails 130 suitably secured between opposite ends of the first set of rails 120, for example, by suitable screws or bolts 134.

The second set of rails 130 are substantially orthogonal to the first set of rails 120, and cooperate with a second pair of tracks 140 which also each include a generally cylindrical guide track 144 extending in a second axial direction 142 which is generally parallel to the surface of the base plate 100 and perpendicular to the first axial direction 118. The guide tracks 144 include open slits in their bottom (see FIG. 7) to permit the rails 130 to be received and retained in, and move relative to, the second pair of tracks 140 in the second axial direction 142. The guide tracks 144 may also include slide bearings or other structures to facilitate easy and smooth movement of the rails 130 relative to the tracks 140.

The stamp holder 22 is suitably secured to the tracks 140, for example, by suitable screws or bolts 150 through the top plate 30. It should be appreciated that the tracks 110, 140 and rails 120, 130 cooperate so that the stamp holder 22 may be moved in the first and second axial directions 118, 142, that is, essentially in a plane parallel to the surface of the base plate 100.

Motion of the stamp holder 22 may be controlled by suitable drives associated with the cooperating tracks 110, 140 and rails 120, 130. For example, multi-position air cylinders 160, 164 may be advantageously used.

As illustrated in FIGS. 5A-8E (and particularly FIG. 7), one air cylinder 160 is suitably secured at one end to a bracket 166 (e.g., by a screw 168). The bracket is also suitably secured to one of the rails 120. The other end 170 of the air cylinder 160 is suitably secured (e.g., by screws 172) to the top plate 30 of the stamp holder 22.

As also illustrated in FIGS. 5A-8E, a second multi-position air cylinder 164 is secured on one end to the end of one of the first rails 120 (e.g., by a threaded rod end 174 received in a threaded hole 176 in the end of the rail 120). The other end 180 of the second air cylinder 164 is suitably secured (e.g., by a screw 182) to a stop block 184 which is itself suitably secured (e.g., by screws 186) to the base plate 100. Supports 190, 192 may also be secured to the base plate 100 (again, e.g., by screws 194, 196) so as to generally be located beneath the cylinder 164 and cylinder end 180 to help to maintain the proper alignment of the cylinder 164.

A platen 200 is also secured to the base plate 100 (e.g., by machine screws 202). The platen 200 includes a raised portion 206 which may be pressed against the back (bottom) of a stamp 60 as described further below.

Specifically, by providing air cylinders 160, 164 with multi-positioned based on the spacing of the stamps 60 in the matrix, the stamp holder 22 may be moved in the first and second axial directions 118, 142 (e.g., the Z and X axes in FIGS. 9-11 as discussed below) to locate any selected one of the stamps 60 over the platen raised portion 206 in the stamping and retracting directions 84, 86 (e.g., the Y axis in FIGS. 9-11 as discussed below).

Stamping may thus be accomplished by positioning the desired stamp 60 over the platen 200 as described above, positioning a workpiece 210 so that the area of its surface which is desired to be stamped with the raised character 62 of the desired stamp 60 is aligned in the stamping direction 84 with the platen raised portion 206. When the base plate 100 and workpiece 210 (see FIG. 11) are suitably pressed together, the platen 200 will press the aligned stamp 60 against the workpiece so that the raised character 62 of the aligned stamp 60 is stamped into the surface of the workpiece 210. It should be appreciated that the other stamps 60, which are not aligned with the platen 200, may simultaneously be pressed against the workpiece surface but, due to the limited free motion allowed by the elasticity of the O-rings 68, 76, 78, 80, they will not be pressed against the workpiece 210 with any particular force and therefore their raised characters 62 will not be stamped into the workpiece 210.

Figure 9:
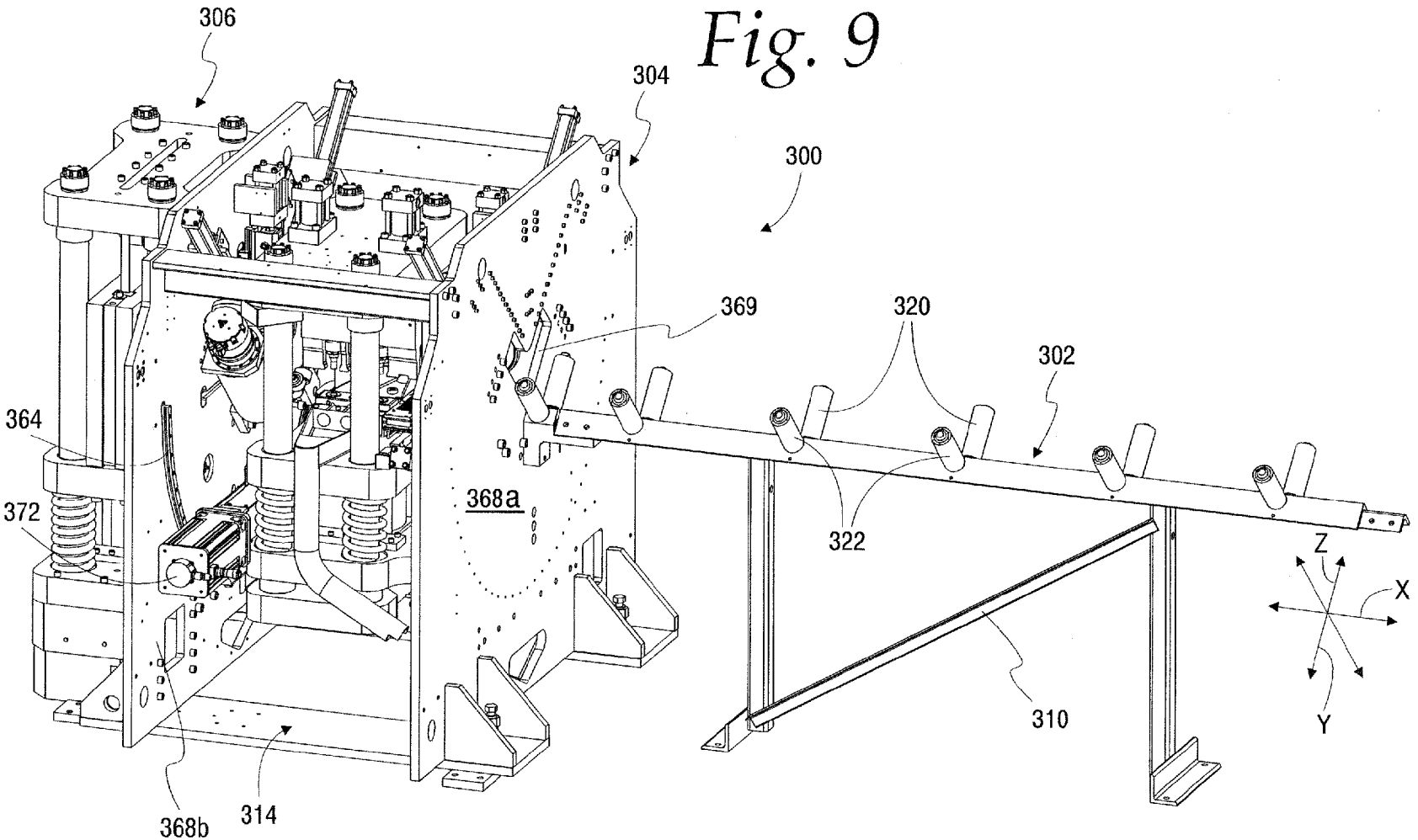
FIG. 9 is an isometric view of a workpiece processing system with which the present invention may be used, including (1) a workpiece gripping and advancing module or machine, (2) a punch press module or machine, and (3) a shear module.

FIG. 9 illustrates a system 300 with which the adjustable stamp 20 of the present invention may be used. For ease of illustration, some of the conventional system components (e.g., hydraulic lines, electrical power conduit, etc.) have been omitted. The system includes a processing path along which a length of a workpiece 210, such as structural steel angle, can be moved and positioned.

Specifically, the illustrated system 300 can make holes in one or both legs of a workpiece 210, and then cut off a shorter piece. While the workpiece 210 as described herein is an angle iron or structural steel angle, it should be appreciated that the present invention could be used with still other workpieces, including flat stock, bar stock, and channel shapes.

Further, the processing system 300 may be regarded as a single, processing system, line, or combination machine which includes three individual modules, assemblies, or machines: (1) a workpiece gripping and advancing module 302, (2) a punch press module or machine 304, and (3) a shear module 306. In the preferred arrangement illustrated, the three modules are bolted together and can be operated together as a system.

Figure 11:
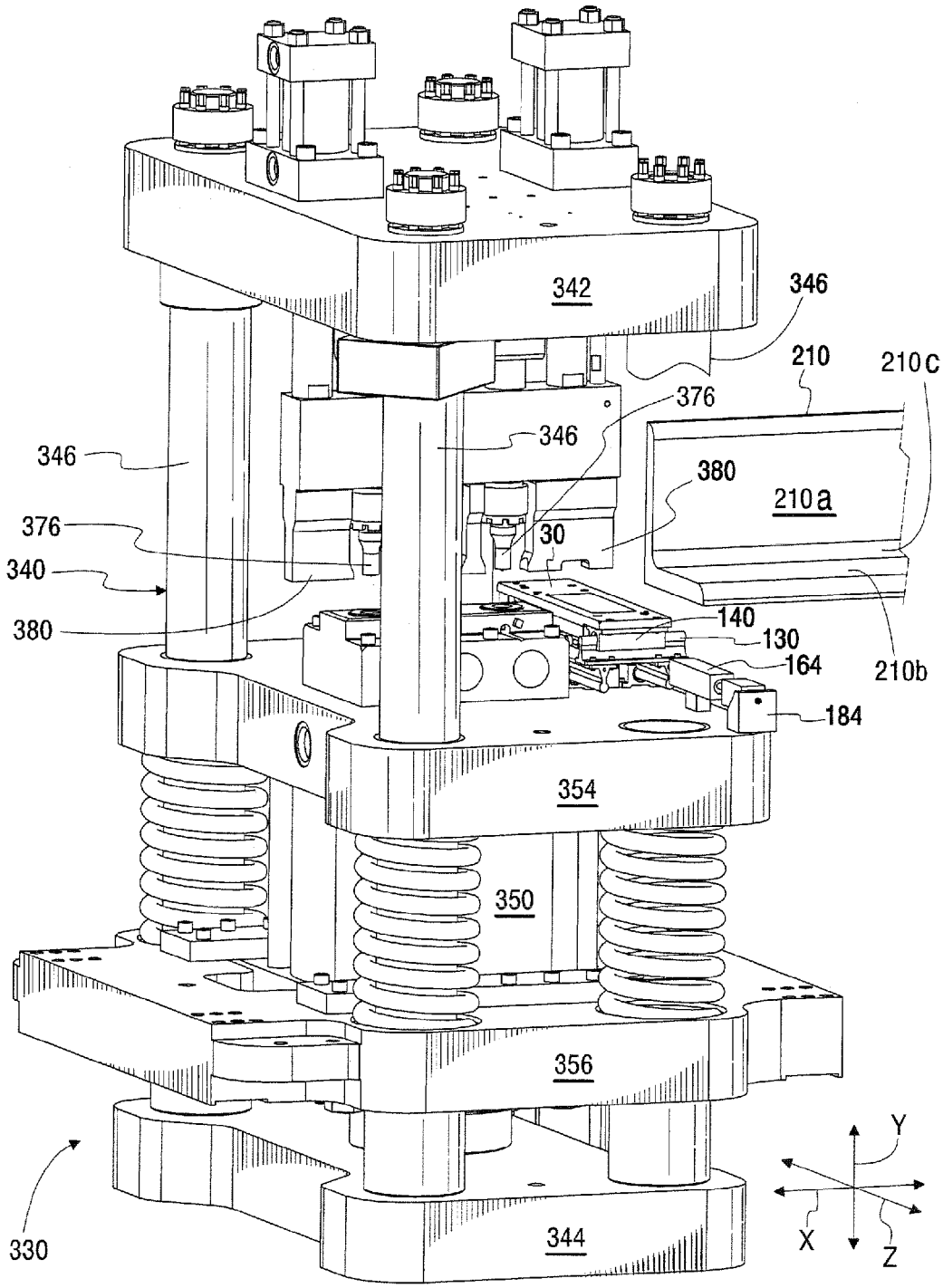
FIG. 11 is an isometric view of a pressing mechanism with which the adjustable stamp of the present invention may be used.

The punch press module or machine 304 incorporates the present invention for stamping characters in the workpiece, in this case an angle iron or structural angle 210 (see FIG. 11). Further, it should be appreciated that the punch press as illustrated for module 304 could incorporate other working tools (e.g., tool(s) which are operated by pressing the tool against the workpiece, such as a drill) in addition to, or instead of, a punch.

The workpiece gripping and advancing module 302 and the shear module 306 may be regarded as modules, assemblies, or machines which can be used in other applications as well as with the punch press module 304 of the present invention. The workpiece gripping and advancing module 302 and the shear module 306 may be of any suitable conventional or special design, the details of which form no part of the present invention. Indeed, a broad aspect of the present invention does not require that the punch press module 304 be used with either the workpiece gripping and advancing module 302 or the shear module 306.

The punch press module 304 is adapted to receive and process the stock length of structural angle 210, or even a much shorter, already cut-to-length section of angle 210. The module 304 is adapted to receive the length of angle 210 (or other shorter or longer piece of a structural angle) in a particular orientation that may be arbitrarily described as extending along an X-axis of a mutually orthogonal X, Y, and Z-axis coordinate system. FIG. 9 illustrates the orientation of the Y-axis and Z-axis of the coordinate system, and the Y-axis and Z-axis together define a plane perpendicular to the length of the angle 210 which is oriented lengthwise along or parallel to the X-axis.

As used herein, components which are described as being moved or oriented "along" the X, Y, or Z-axis or moved to a location along or on the X, Y, or Z-axis should be understood to be moved or oriented on a path that is spaced from, but parallel to, the particular designated axis that passes through the coordinate system origin. Further, it should be understood that references to movement in the X, Y, or Z-axis "direction" may refer to either of the two opposite directions along the particular designated axis. Still further, in the orientation shown in FIGS. 9-10, the first axial direction 118 discussed previously with respect to movement of the stamp holder 22 (FIG. 7) corresponds to the Z-axis direction, the second axial direction 142 corresponds to the X-axis direction, and the stamping and retracting directions 84,86 correspond to the Y-axis direction in the FIG. 10 orientation (stamping being toward the upper left in FIG. 10 and retracting being toward the lower right).

Figure 3:
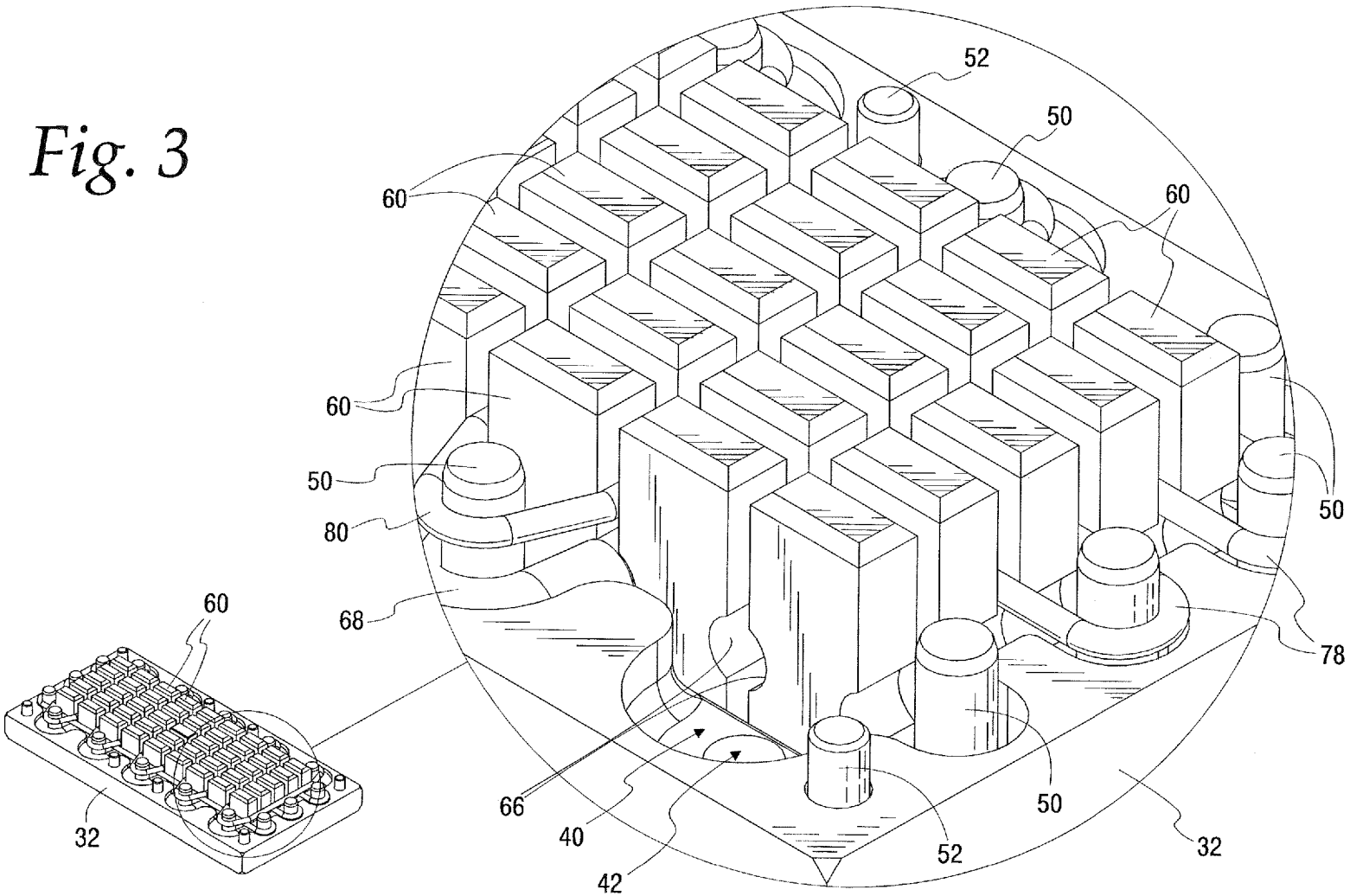
FIG. 3 is an enlarged view of a portion of FIG. 2B, with a supporting O-ring and dowel pin omitted to illustrate further details.

In the preferred form of the processing system 300 illustrated in FIG. 3, the angle 210 is supported and processed at a convenient height above the floor, and to this end, the angle gripping and advancing module 302 includes a suitable support frame 310 which may have any suitable conventional or special construction (the details of which form no part of the present invention), and the punch press module 304 includes a support frame 314.

As illustrated in FIG. 11, the angle 210 has a first leg 210*a* and a second leg 210*b* which diverge from a vertex or bend or heel 210*c*. The angle 210 is oriented so that the heel 210*c* projects downwardly while the legs 210*a* and 210*b* extend upwardly. For a conventional angle 210 which is typically employed in a variety of uses, the first leg 210*a* and second leg 210*b* define a right angle (i.e., the first leg 210*a* and second leg 210*b* diverge from the heel 210*c* to define a 90 degree included angle). The first leg 210*a* is supported on rollers 320 (FIG. 9) which are part of the angle gripping and advancing module 302, and the second leg 210*b* is supported on a plurality of rollers 322 which are also part of the angle gripping and advancing module 302.

Figure 10:
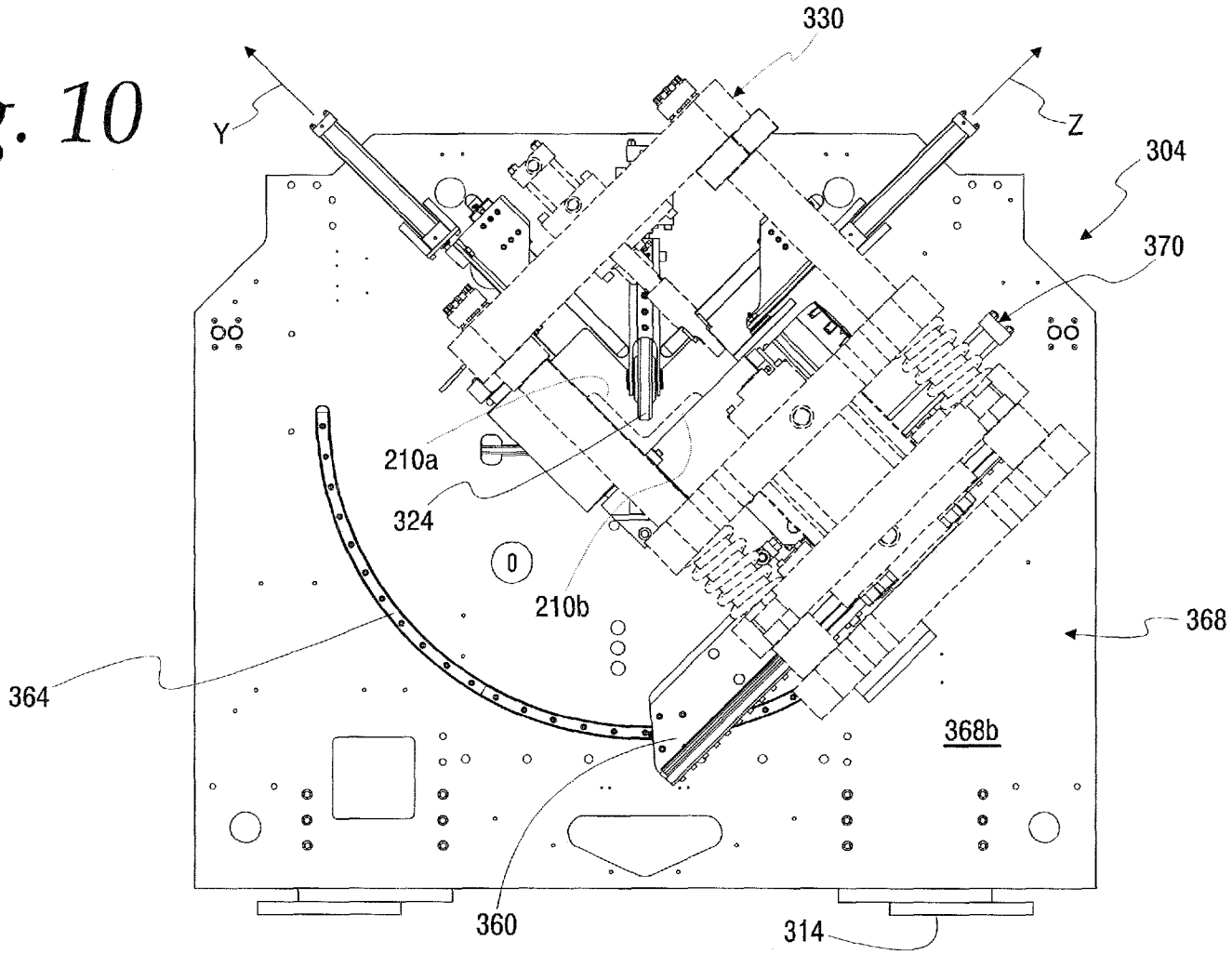
FIG. 10 is a cut away side view illustrating the left side plate (in FIG. 9) supporting the pressing mechanism which is illustrated in one rotational position.

As best illustrated in FIGS. 10-11, the first leg 210*a* projects from the heel 210*c* in the direction of the Y-axis, with the heel 210*c* extending along the X-axis, whereby the face of the first leg 210*a* lies in a plane which includes lines parallel to the X and Y-axes and is perpendicular to the Z-axis. The second leg 210*b* projects from the heel 210*c* in the direction of the Z-axis, whereby the face of the second leg 210*b* lies in a plane which includes lines parallel to the X and Z-axes and is perpendicular to the Y-axis.

Although the angle gripping and advancing module 302 forms no part of the present invention, it should be appreciated that the module 302 advantageously allows the angle 210 to be moved along the X-axis through the punch press module 304 and through the angle shear module 306. The angle gripping and advancing module 302 as described are particularly advantageous when the present invention is used with an angle 210 as a workpiece, though it should be understood that still other supports for the workpiece could be used (including the support illustrated in U.S. Pat. No. 7,418,773, the full disclosure of which is hereby incorporated by reference), including supports for workpieces which are not angles 210.

A suitable carriage or gripper assembly may be used to control movement of the angle 210 along the gripping and advancing module 302. For example, a frictionally-engaging drive wheel 324 (see FIG. 10) may be provided, where the wheel 324 may be biased against the angle 210 whereby turning of the wheel 324 will frictionally advance the angle 210 along the X-axis. It should be understood, however, that the details of a carriage or gripper assembly are unimportant to the present invention except to the extent that they will adequately advance the angle. Indeed, the punch press module 304 may be advantageously used without any automatic angle gripping and advancing module 302 if the angle 210 is manually moved into, through, and out of the punch press module 304. However, of course, the processing of a structural angle 210 is more efficient and less labor intensive if some sort of angle gripping and advancing mechanism, such as the module 302, is employed to feed the angle 210 through the punch press module 304.

The angle 210 is fed into the punch press module 304, where it may be punched and/or drilled according to the requirements of the intended use of the angle 210. As described in greater detail hereafter, the module 304 includes a pressing mechanism 330 (see particularly FIG. 11) which is supported for rotary movement around the X-axis as well as also being selectively movable in any rotary position in a linear direction perpendicular to the X-axis (and particularly movable in a plane containing the Y and Z-axes depending on the rotary position of the pressing mechanism 330).

Broadly, the pressing mechanism 330 of the illustrated embodiment includes a rigid frame 340 having a top plate 342, a bottom plate 344, and tie rod tubes 346 connecting those plates 342, 344 at their corners. A suitable cylinder 350 is between a support plate 354 and an earth plate 356, with the support and earth plates 354, 356 having cylindrical holes in their corners through which the tie rod tubes 346 extend, with the tubes 346 being able to move linearly through those holes. The support plate 354 may advantageously be the cylinder cap of (and therefore integral with) the cylinder 350.

FIGS. 9-10 illustrate one sample structure which may advantageously be used to support the pressing mechanism 330 for the rotary and linear movement previously described. In the illustrated structure, rails 360 on opposite sides of the pressing mechanism 330 are each suitably supported at least at two locations for rotary movement around the X-axis along arcuate tracks 364 on opposite side plates 368 (one side plate 368*a* being an entry side plate and the other being an exit side plate 368*b*). In the advantageous embodiment illustrated, the side plates 368*a*, 368*b* are spaced apart, are parallel to each other, and are each perpendicular to the X-axis. The entry side plate 368*a* includes an opening or aperture 369, and the exit side plate 368*b* includes a similar opening or aperture, the openings accommodating passage and positioning of the structural angle 210 into and through the punch press module 304.

The earth plate 356 of the pressing mechanism 330 is suitably mounted on the rails 360 so that it may be moved linearly along the rails 360. Thus, it should be appreciated that the pressing mechanism 330 can be both rotated around the X-axis and also moved linearly in the plane of the Y and Z axes, with its earth plate 356 fixed in any given position of the rigid frame 340 relative to an angle 210 extending through the pressing mechanism 330.

Suitable drives allow the rails 360 to be selectively moved through the arcuate path of the tracks 364 as well as allowing the pressing mechanism 330 to be moved linearly along the rails 360. For example, a drive cylinder (see FIG. 10) secured between the side plate 368*b* and the rail 360 may be controlled to move the rail 360 through the arcuate path. Further, a servo motor 372 (see FIG. 9) driving a ball screw are secured between the rail 360 and the pressing mechanism 330 to control the linear position of the pressing mechanism 330 on the rail 360.

It should be understood that details of this structure for moving the pressing mechanism 330 are not a part of the present invention, though it should also be understood that the described movement of the pressing mechanism 330 (however accomplished) will advantageously allow not only any drill and/or punch associated with the pressing mechanism 330 to be oriented and positioned as desired relative to the angle 210, but the described movement will also allow the adjustable stamp 20 of the present invention (which is also carried and operated by the pressing mechanism 330) to be similarly oriented and positioned as desired relative to the angle 210.

It should be appreciated that the pressing mechanism 330 may be suitably controlled so that the top plate 342 and support plate 354 may be suitably pressed together. During punching operation, for example, the support plate 354 may be raised up against one side of one leg (210*b* in FIG. 11) of the angle 210, and the top plate 342 may be pressed down so that one or more punches 376 (see FIG. 11) may be driven down into the other side of the angle leg 210*b* and then punched entirely through the leg 210*b*.

The same described motion of the top plate 342 and support plate 354 together may also be used to press the adjustable stamp 20 against the angle 210. That is, the previously described adjustable stamp 20 is also secured to the support plate 354 (see particularly FIG. 11) (i.e., the support plate 354 is the previously described base plate 100). It should be appreciated that proper orientation of the stamp 20 relative to the angle 210 will allow the stamping of any character on the angle 210. Specifically:

(a) The pressing mechanism 330 may be rotated around the X-axis to properly orient the support plate 354 relative to the leg of the angle 210 on which it is desired to stamp a character. For example, as illustrated in FIGS. 10-11, the support plate 354 is parallel to the angle leg 210*b*, so that it (and the adjustable stamp 20 thereon) may be moved toward the leg 210*b* in the Y-axis direction which is perpendicular to the bottom surface of the leg 210*b*. Further, by rotating the pressing mechanism 330 clockwise ninety degrees around the X-axis (as previously described), the orientation may be changed so that movement of the support plate 354 would be toward the other angle leg 210*a* in the Z-axis direction perpendicular to the bottom surface of that other leg 210*a*.

(b) The pressing mechanism 330 may also be moved linearly along the rails 360 (in the Z-axis direction in FIGS. 10-11 when stamping angle leg 210*b*) in order to position the adjustable stamp 20 so that its platen 200 (which is fixed on the support plate 354) is laterally positioned relative to the angle 210 where desired (e.g., aligned with the center of the leg 210*b* along the Z-axis, or near the bend 210*c*, or near the outer lateral edge of the leg 210*b* spaced furthest away from the bend 210*c*).

(c) Finally, the angle 210 itself may be moved in the X-axis direction to position the angle 210 longitudinally so that the area along its length where the particular selected character is to be stamped is positioned over the platen 200.

It should be appreciated that the above three ranges of motion will permit the platen 200 to be positioned relative to virtually any location on the angle legs 210*a*, 210*b* so that it will be moved perpendicular to the surface at that location when the support plate 354 is moved (e.g., in the Y or Z-axis directions) as previously described. Moreover, by adjustment of the stamp holder 22 over the platen 200 as previously discussed, the particular selected stamp 60 may be positioned over the platen 200 so that pressing the support plate 354 toward the leg 210*a* or 210*b* will also press the carried platen 200 which in turn will press the selected stamp 60 against the leg 210*a* or 210*b* to imprint the character of the selected stamp 60 on the leg 210*a* or 210*b* at the selected location. Assuming multiple characters are intended to be imprinted in longitudinal alignment along a leg 210*a* or 210*b*, once the platen 200 is initially aligned by the rotational and linear movement of the pressing mechanism 330 (described in paragraphs (a) and (b) above), subsequent characters may be selected by (i) advancing the angle 210 in the X-axis direction (described in paragraph (c) above) and, in order, (ii) (a) positioning the next selected stamp 60 over the platen 200 by use of the air cylinders 160, 164 as previously described and (b) pressing the support plate 354 (e.g., by the cylinder 350) toward the leg 210*a* or 210*b*.

It should also be appreciated that it would be within the broad scope of the invention to use any conventional or special structure which would move or bias the support plate 354 with sufficient force to imprint the character of the selected stamp 60 in the leg 210*a* or 210*b*. Further, it should also be appreciated that the adjustable stamp 20 may advantageously use the same mechanism (e.g., the main punch cylinder) as is used to, for example, punch holes in the legs 210*a*, 210*b*, and thereby eliminate any need for separate mechanisms to press the punches 376 and stamps 60 in the separate punching and stamping operations. For example, the pressing mechanism and the pressing mechanism support structures disclosed in my own applications (filed concurrently herewith on Oct. 30, 2009 as Ser. No. 12/609,507, titled "Support for Tool Press", and Ser. No. 12/609,527, titled "Tool Press Drive", the disclosures of which are hereby fully incorporated by reference) could be used to support and move the adjustable stamp 20 of the present invention.

Thus it should be appreciated that the top plate 342 when moved toward the angle leg 210*a* or 210*b* (down toward leg 210*b* in the FIG. 11 orientation) may also advantageously move a backing support or support block 380 (see FIG. 11) which will engage the back side (top side in FIG. 11) of the angle leg 210*a* or 210*b* in order to hold the angle 210 so that the character of the stamp 60 being pressed against the leg 210*a* or 210*b* from the other side may be imprinted on the leg 210*a* or 210*b* (and will not merely lift up the angle 210 without imprinting the character). During such stamping operation, the punches 376 are not driven down into the leg 210*a* or 210*b*. Thus, the adjustable stamp 20 of the present invention may be readily used with a punching module, with stamping and punching accomplished via the use of the same pressing structure (and thereby eliminating the need for two separate pressing structures, one to control punching and the other to control stamping).

Still other aspects, objects, and advantages of the present invention can be obtained from a study of the specification, the drawings, and the appended claims. It should be understood, however, that the present invention could be used in alternate forms where less than ail of the objects and advantages of the present invention and preferred embodiment as described above would be obtained.

The invention claimed is:

1. An adjustable stamp for stamping characters on a workpiece, comprising:

a base plate with a platen;

a plurality of stamps each having a raised character on one side;

a stamp holder;

a support securing said stamps to said holder in an array with said one side of said stamps facing a stamping direction and the opposite side of said stamps facing a retract direction opposite the stamping direction, said support allowing limited free motion of said stamps relative to each other in said stamping and retract directions, and mounted to said base plate supported for movement in a plane substantially perpendicular to the stamping direction to selectively position a selected one of the stamps over said platen with said platen facing said opposite side of said selected one of the stamps;

whereby when the base plate and the workpiece are pressed together, the raised character of the selected one of the stamps is stamped into the workpiece by the platen pressing against the opposite side of the one stamp, and the free motion of the other stamps prevents their raised characters from being stamped into the workpiece.

2. The adjustable stamp of claim 1, wherein
said stamp holder comprises a character holding plate having an opening therethrough; and
said support comprises
a plurality of dowel pins surrounding said character holding plate opening, and
a plurality of elastic O-rings looped over said dowel pins on opposite sides of said character holding plate opening to support said stamps in said opening of said character holding plate.

3. The adjustable stamp of claim 2, wherein said character holding plate opening is substantially rectangular and said array is a generally rectangular matrix with a plurality of columns and rows in said opening.

4. The adjustable stamp of claim 2, wherein one set of said O-rings extends in one ring direction between said dowels across said character holding plate opening and the remaining ones of said O-rings extend between said dowels in a second ring direction perpendicular to said first ring direction.

5. The adjustable stamp of claim 2, wherein said stamps include grooves between said one sides and said opposite sides, and at least some of said O-rings are received in said grooves to support said stamps, and said elasticity of said O-rings allows said limited free motion.

6. The adjustable stamp of claim 5, wherein said O-rings provide selected spacing between the supported stamps in the array.

7. The adjustable stamp of claim 1, further comprising a null stamp supported in the array with said plurality of stamps, said null stamp being flat on its one side.

8. The adjustable stamp of claim 1, wherein said stamping direction is substantially perpendicular to the surface of the workpiece when stamping.

9. The adjustable stamp of claim 1, wherein said support is mounted to said base plate by first and second tracks extending in first and second axial directions substantially perpendicular to each other, said first and second axial directions also being substantially perpendicular to the stamping and retracting directions.

10. The adjustable stamp of claim 9, wherein:
said second track is carried by said first track, and said support is carried by said second track;
a first drive selectively positions the second track along said first axial direction relative to said base plate;
a second drive selectively positions the support along the second axial direction relative to said first track;
whereby said supported stamps are positioned relative to the platen whereby the stamp having the raised character to be stamped is selectively positioned over said platen.

11. The adjustable stamp of claim 10, wherein said first and second tracks are slide bearings.

12. The adjustable stamp of claim 10, wherein said first and second drives are multi-position air cylinders.

13. The adjustable stamp of claim 10, wherein
said stamp holder comprises a character holding plate having an opening therethrough; and
said support comprises
a plurality of dowel pins surrounding said character holding plate opening, and
a plurality of elastic O-rings looped over said dowel pins on opposite sides of said character holding plate opening to support said stamps in said opening of said character holding plate.

14. The adjustable stamp of claim 13, wherein said stamps include grooves between said one sides and said opposite sides, and at least some of said O-rings are received in said grooves to support said stamps, and said elasticity of said O-rings allows said limited free motion.

15. The adjustable stamp of claim 1, further comprising a base plate drive adapted to rotate the base plate around the workpiece to orient the stamping direction substantially perpendicular to the surface of the workpiece to be stamped.

16. A punch and stamp for working on a workpiece, comprising:
a base plate and a top plate secured together for controlled motion toward and away from each other;
a workpiece drive adapted to move the workpiece longitudinally between the base plate and top plate;
a biasing drive adapted to move said base and top plates toward and away from each other;
a punching member secured to said top plate and adapted to be selectively extended from the top plate to punch a hole in the workpiece when the base and top plates are moved toward each other; and
an adjustable stamp secured to said base plate, and including
a platen;
a plurality of stamps each having a raised character on one side;
a stamp holder;
a support securing said stamps to said holder in an array with said one side of said stamps facing a stamping direction and the opposite side of said stamps facing a retract direction opposite the stamping direction, said support
allowing limited free motion of said stamps relative to each other in said stamping and retract directions, and
supported for movement on said base plate in a plane substantially perpendicular to the stamping direction to selectively position a selected one of the stamps over said platen with said platen facing said opposite side of said selected one of the stamps;
whereby when the base biasing drive moves the base and top plates together so that the selected one of the stamps engages the workpiece
the raised character of the selected one of the stamps is stamped into the workpiece by the platen pressing against the opposite side of the one stamp, and
the free motion of the other stamps prevents their raised characters from being stamped into the workpiece.

17. The punch and stamp of claim 16, wherein
said stamp holder comprises a character holding plate having an opening therethrough; and
said support comprises
a plurality of dowel pins surrounding said character holding plate opening, and
a plurality of elastic O-rings looped over said dowel pins on opposite sides of said character holding plate opening to support said stamps in said opening of said character holding plate.

18. The punch and stamp of claim 17, wherein said character holding plate opening is substantially rectangular and said array is a generally rectangular matrix with a plurality of columns and rows in said opening.

19. The punch and stamp of claim 17, wherein one set of said O-rings extends in one ring direction between said dowels across said character holding plate opening and the remaining ones of said O-rings extend between said dowels in a second ring direction perpendicular to said first ring direction.

20. The punch and stamp of claim 17, wherein said stamps include grooves between said one sides and said opposite sides, and at least some of said O-rings are received in said grooves to support said stamps, and said elasticity of said O-rings allows said limited free motion.

21. The punch and stamp of claim 16, wherein said support is mounted to said base plate by first and second tracks extending in first and second axial directions substantially perpendicular to each other, said first and second axial directions also being substantially perpendicular to the stamping and retracting directions.

22. The punch and stamp of claim 21, wherein:

said second track is carried by said first track, and said support is carried by said second track;

a first drive selectively positions the second track along said first axial direction relative to said base plate;

a second drive selectively positions the support along the second axial direction relative to said first track;

whereby said supported stamps are positioned relative to the platen whereby the stamp having the raised character to be stamped is selectively positioned over said platen.

23. The punch and stamp of claim 16, further comprising a base plate drive adapted to rotate the base plate around the workpiece to orient the stamping direction substantially perpendicular to the surface of the workpiece to be stamped.

* * * * *